US005655894A

United States Patent [19]

Fritsch

[11] Patent Number: 5,655,894

[45] Date of Patent: Aug. 12, 1997

[54] CONTROLLED PREVENTION OF PREMATURE SNUFFLE VALVE ACTUATION IN HIGH PRESSURE MEMBRANE PUMPS

[75] Inventor: Horst Fritsch, Leonberg, Germany

[73] Assignee: Lewa Herbert Ott GmbH & Co., Leonberg, Germany

[21] Appl. No.: 442,411

[22] Filed: May 16, 1995

[30] Foreign Application Priority Data

Jun. 15, 1994 [DE] Germany ..... 44 20 863.4

[51] Int. Cl.[6] ..... F04B 43/14

[52] U.S. Cl. ..... 417/387

[58] Field of Search ..... 417/386, 387, 417/395

[56] References Cited

U.S. PATENT DOCUMENTS

| | | | |
|---|---|---|---|
| 2,902,936 | 9/1959 | Bradley | 417/387 |
| 3,277,829 | 10/1966 | Burgert | 417/387 |
| 3,354,831 | 11/1967 | Acker et al. | 417/387 |
| 4,365,745 | 12/1982 | Beck | 417/387 X |
| 4,430,048 | 2/1984 | Fritsch | 417/395 X |
| 5,246,351 | 9/1993 | Horn | 417/387 |

FOREIGN PATENT DOCUMENTS

| | | | |
|---|---|---|---|
| 1376286 | 9/1964 | France | 417/387 |
| 1653586 | 8/1971 | Germany . | |
| 2104783 | 6/1972 | Germany . | |
| 2333876 | 1/1975 | Germany . | |

*Primary Examiner*—Richard E. Gluck

*Attorney, Agent, or Firm*—Jacobson, Price, Holman & Stern, PLLC

[57] ABSTRACT

A hydraulically driven membrane pump, particularly a high pressure membrane pump, having a membrane which is held on its edges by a clamp between a pump housing and a pump cover, which membrane separates a pumping space from a hydraulic compression space, and may particularly be a metal membrane. A hydraulic membrane drive in the form of a reciprocating displacement piston is slidably mounted in a cylindrical bore in the pump housing, which piston is disposed between the compression space and a reservoir space for the hydraulic fluid. A leak replenishment device including a snuffle link in the form of a connecting channel between the compression space and the reservoir space, which snuffle link is normally closed off by an underpressure-controlled spring-loaded snuffle valve. The snuffle link between the compression space and the reservoir space is controlled via the position of the piston, wherewith the piston serves as the slide element of a slide valve which blocks the snuffle link between the compression space and the reservoir space, at least at the beginning of the suction stroke of the piston, and only opens the link when the piston has been retracted through a part of its suction stroke.

8 Claims, 5 Drawing Sheets

CONTROLLED PREVENTION OF PREMATURE SNUFFLE VALVE ACTUATION IN HIGH PRESSURE MEMBRANE PUMPS

FIELD OF THE INVENTION

The invention relates to a hydraulically driven membrane pump.

BACKGROUND OF THE INVENTION

With known membrane pumps of the general subject type, a leak replenishment device is customarily provided which employs a snuffle link in the form of a channel connecting the compression space and the reservoir space. This channel is ordinarily closed off by a spring-loaded snuffle valve which is controlled by the underpressure in the hydraulic system which drives the membrane. When the piston of the pump, in the course of its suction stroke, produces an excess underpressure in the hydraulic system, due to an insufficiency of hydraulic fluid, the snuffle valve responds to the excess underpressure and opens up the fluid link between the compression space and the reservoir space in the hydraulic system. Thus as a result of the sensing of the excess underpressure by the snuffle valve, the deficient amount of hydraulic fluid in the compression space is supplied, via the channel coming from the reservoir space.

By convention, "excess underpressure" is understood to mean an underpressure the magnitude of which (considered as an absolute value, not a negative value) is greater than is desirable. Likewise, an "underpressure peak" is defined as a peak in the absolute value of the underpressure.

In such replenishment of leaks, a problem arises in that peaks in the underpressure occur at the beginning of the suction stroke of the piston, leading to premature response of the snuffle valve. In high pressure membrane pumps, such marked underpressure peaks, so-called "Joukowsky impulses", tend to occur at the beginning of the suction phase, when the liquid column in the suction line is accelerated backward when the suction valve is opened. The resulting premature response of the snuffle valve causes overfilling of the compression space with hydraulic fluid, resulting in excessive flexure of and excessive stress on the membrane during the compression stroke.

To avoid such a premature response of the snuffle valve as a consequence of underpressure peaks, and thereby to avoid the resulting overfilling of the hydraulic compression space with hydraulic fluid, it is known to influence the leak replenishment by means of a so-called "membrane-position-dependent control". With such a solution, the membrane itself actuates a control valve, wherewith the slide element of a slide valve controlled by the membrane is moved in response to the membrane position when the piston is in the region of its end position, wherewith, with the membrane generally in its end position, the slide valve opens the link between the reservoir space and the compression space. Under this arrangement, leak replenishment is carried out only when the membrane reaches a prescribed limit position when the hydraulic pump piston is at the end of the suction stroke.

Further, a variant membrane apparatus is known which can also prevent premature leak replenishment. In this apparatus, a control system is provided which is also influenced by the given membrane position, which control system employs spring-loaded control rods. The control rods hold the leak replenishment valve by mechanical means in a normally closed position. When the membrane in the end position of the suction stroke, i.e. with the pump piston at the end of the piston's suction stroke, causes a movably guided perforated plate to move in a certain way against the force of springs, a translational movement of the control rods results, releasing the leak replenishment valve.

Known control systems of this general type governed by the membrane position have the disadvantage that they are of complex design; further, they must be precisely adjusted in order to function accurately under conditions of short membrane excursions of the type which occur particularly in the case of high pressure membrane pumps having metal membranes.

Accordingly, the underlying problem of the invention is to devise a membrane pump of the general type under consideration, whereby the described disadvantages are eliminated, wherewith in particular the pump is inexpensive to design and fabricate and prevents premature response of the snuffle valve, particularly during the period when the actuating underpressure peak is present, so that the snuffle valve will not be opened by such peaks at the beginning of the suction stroke.

SUMMARY OF THE INVENTION

The essential inventive concept is that the snuffle link between the compression space and the reservoir space should not be controlled by the membrane position but by the position of the displacement piston itself. In implementing this concept, one can configure the system such that the piston serves as a control element, particularly a control slide valve, which blocks off the snuffle link between the compression space and the reservoir space, at least at the beginning of the suction stroke. The slide valve only opens up the link when the pump piston has executed a portion of its retracting suction stroke. Preferably, the opening of the link by the piston occurs when the piston has been retracted to the extent of approximately one half of its suction stroke.

This arrangement provides an effective means of preventing premature actuation of the snuffle valve by the underpressure peak which occurs at the beginning of the suction stroke, because at that time the snuffle link between the compression space and the reservoir space is definitely still closed off by the piston.

According to a refinement of the invention, it is possible for the piston to operate directly or indirectly as a control slide valve without employing a design which bases the control on the membrane position. It is also possible for the control to occur on the high pressure side or the low pressure side, wherewith the piston serves to block off and to open in a controlled fashion either the compression-space-side channel of the snuffle link, or the reservoir-space-side channel of the link.

In an arrangement where the piston holds the compression—space-side channel of the snuffle link closed, at least at the beginning of the suction stroke, preferably the configuration is such that the compression-space-side channel of the snuffle link opens out into the cylindrical bore for the piston. For purposes of leak replenishment, this compression-space-side channel is not unblocked by the piston until the piston has executed a certain part of its suction stroke; the underpressure peak which occurs at the beginning of the suction stroke is thereby rendered ineffective.

In an arrangement where the piston holds a reservoir-space-side channel of the snuffle link closed for a certain time at the beginning of its suction stroke, the configuration may be devised such that the reservoir-space-side channel of the snuffle connection opens out into the cylindrical bore which accommodates the piston. When the piston has been retracted through a part of its suction stroke, this reservoir-space-side channel is then brought into communication with a channel in the piston, which latter channel, i.e. the extension thereof, opens out into the reservoir space.

In a refinement of the preceding, the main piston may be employed as an indirect control element, wherewith, e.g., the rear end of the piston may be connected to a slide valve (sleeve valve) extending parallel to it, wherewith the slide element of part of the slide valve operates in a part of the reservoir-space-side channel of the snuffle link, and, by virtue of the slide element having a hollow construction, the fluid link to the reservoir space from the snuffle valve may be blocked or opened up by the slide element depending on the position of the displacement piston (main piston) along the piston stroke.

Overall the invention provides simple means which enable preventing the snuffle valve from responding prematurely to the underpressure peak which occurs in the hydraulic system at the beginning of the suction stroke, which premature response would lead to overfilling of the compression space with hydraulic fluid.

BRIEF DESCRIPTION OF THE DRAWINGS

The invention will be described in more detail hereinbelow, with reference to the accompanying drawings.

DETAILED DESCRIPTION OF THE PREFERRED EMBODIMENTS

Figure 1:
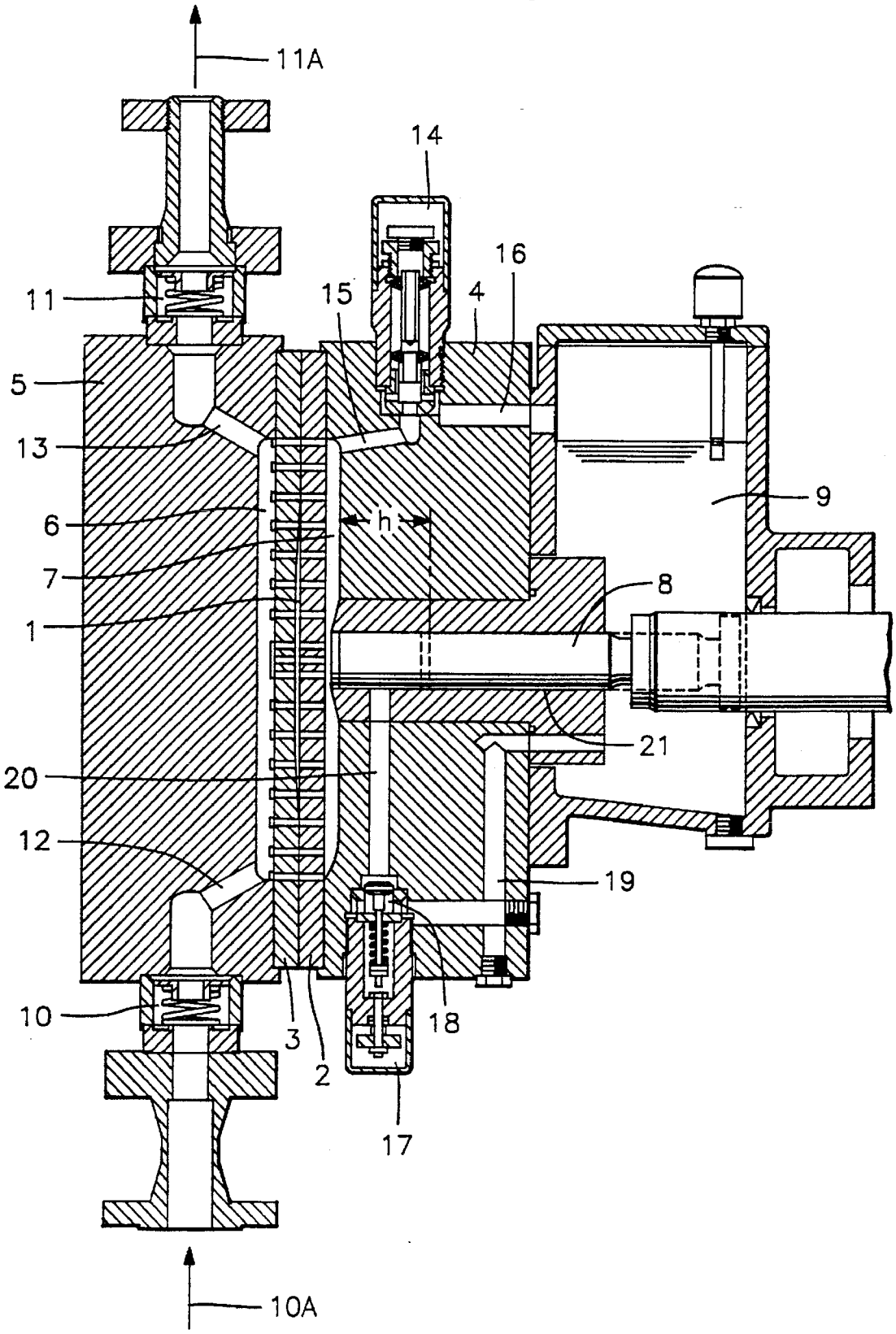
FIG. 1 is a schematic cross section of a hydraulically driven membrane pump with high-pressure-side means of preventing premature snuffle valve actuation, which means are controlled via the piston.

The hydraulically driven membrane pump shown in FIG. 1 is a high pressure membrane pump employing a metal membrane 1 held by clamp means between two perforated plates 2, 3 wherewith plate 2 has a flat interior surface and plate 3 has a concave interior surface. Plates 2 and 3 are themselves held by clamp means between a pump housing 4 and a pump cover 5 which cover can be dismounted from the end side of the housing.

The membrane 1 separates a pumping space 6 from a compression space 7 filled with hydraulic fluid.

The hydraulic membrane drive of the illustrated pump is provided by a reciprocating pump piston 8 which is slidably and sealingly mounted in the pump housing 4 between the compression space 7 and a reservoir space 9 for the hydraulic fluid. In the embodiment illustrated, the piston 8 is sealed by means of a so-called ground seal by grinding to provide a close mating.

The pump cover 5 has the customary spring-loaded inlet valve 10 and spring-loaded outlet valve 11. Valves 10 and 11 are in fluid communication with the pumping space 6 via an inlet channel 12 and an outlet channel 13, such that a suction stroke of the displacing piston 8 in a rightward direction in FIG. 1, and thereby a corresponding excursion of the membrane 1, results in suction of the medium being pumped, in the direction of the arrow 10A, namely through the inlet valve 10 and the inlet channel 12 and into the pumping space 6. A subsequent compression stroke of the piston in a leftward direction in FIG. 1, and thereby a corresponding excursion of the membrane 1, results in a measured displacement of the medium out of the pumping space 6 via the outlet channel 13 and the outlet valve 11, in the direction of the arrow 11A.

In order to prevent overfilling of the compression space 7 with hydraulic fluid and thereby to protect the membrane 1 against excessive flexure and excessive stress during the compression stroke, a pressure limiting relief valve 14 is provided which is in fluid communication with the compression space 7 and the reservoir space 9 via respective channels 15, 16. Valve 14 is adjusted such that if an excessive pressure occurs in the compression space 7 at the end of the compression stroke of the piston 8, valve 14 will open, allowing the excess hydraulic fluid to return to the reservoir space 9 via the channels 15, 16.

Similarly, in order to prevent cavitation at the end of the membrane suction stroke, and to provide for replenishment of hydraulic fluid to compensate for leakage, a leakage replenishment device 17 is provided, having a customary springloaded, underpressure-controlled snuffle valve 18 or a type of poppet valve, which is in fluid communication with the reservoir space 9 via a channel 19. A second channel 20 connects the replenishment device 17 and snuffle valve 18 to the compression space 7. As seen from FIG. 1, channel 20 leads directly to the cylinder 21 associated with piston 8, and opens out into the cylinder. In the embodiment illustrated, the location in cylinder 21 where channel 20 opens out is at approximately the midpoint of the compression stroke h of the piston 8, i.e. in the middle between the forward and reverse dead center points of the piston.

As is seen, at the beginning of the suction stroke of piston 8, the piston blocks off the compression-space-side channel 20 of the leak replenishment device 17, wherewith the snuffle link offering fluid communication between the compression space 7 and the reservoir space 9 is interrupted. The piston 8 opens up this link only after completing a part of the suction stroke. Only then is it possible for the leak replenishment device 17 and the snuffle valve 18 to provide for replenishing of hydraulic fluid from the reservoir space 9 in the event of excessive underpressure resulting from leakage losses.

The arrangement illustrated, wherein the means of prevention of premature snuffle action is effective on the high pressure side, is particularly suitable for membrane pumps which have an adjustable stroke wherewith the middle position of the piston is constant. It is seen that the piston 8 is utilized as a temporary means of blocking the leak replenishment device 17 so as to prevent premature response of device 17 at the beginning of the suction stroke of the piston 8, when the piston is in the position according to FIG. 1 in which the forward end surface of the piston is approximately flush with the corresponding wall of the compression space 7. With the piston in this position, corresponding to position 3*p* of the two diagrams of FIG. 2, the compression-space-side channel 20 of the leak replenishment device 17 is blocked off by the piston 8. When the piston 8 has moved to the position corresponding to position 4*p* in the diagrams of FIG. 2, in the course of the suction stroke of piston 8, the suction pressure ps is sufficient to cause the inlet valve 10 to open.

Figure 2:
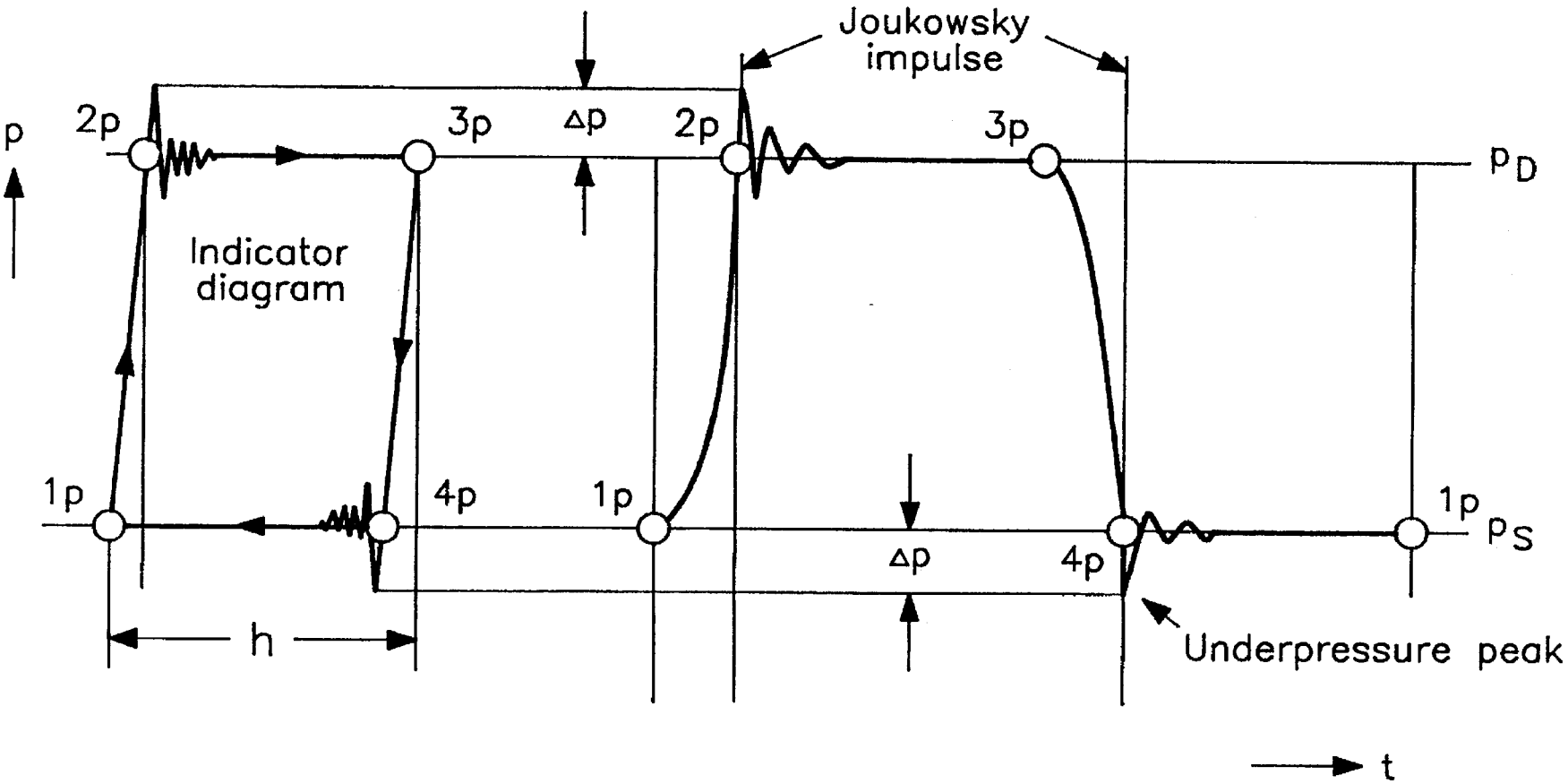
FIG. 2 consists of two plots of characteristic parameters during the compression stroke and suction stroke of the membrane pump (the first plot being an indicator diagram of the pressure over the stroke, and the second being a plot of pressure versus time), wherewith the underpressure peak at the start of the suction stroke is illustrated.

Thereafter, the liquid column in the inlet line 12, inlet valve 10, and pumping space 6 must unavoidably be accelerated, thereby producing an underpressure peak with amplitude p, as seen at position 4*p* of the diagrams of FIG. 2 (in time plot, intersection of bold plot line and ps pressure level line). This underpressure peak, known as the "Joukowsky impulse", would ordinarily produce a premature response of the snuffle valve 18 and thereby an undesired overfilling of the compression space 7 with hydraulic fluid from the reservoir space 9. However, during this period the compression-space-side channel 20 is still blocked off by the piston 8. Thus, the snuffle valve is unable to respond to the above-mentioned underpressure peak, the snuffle action being prevented by the described means which is purely controlled by the piston. Only toward the end of the suction stroke, after the piston 8 has nearly reached the midpoint of the suction stroke h does the end face of the piston 8 reach the terminal opening of the compression-space-side channel 20 and begin to expose the opening. Thus the replenishment of hydraulic fluid from the reservoir space 9 via channels 19 and 20 into the compression space 7 becomes possible during the remaining short segment of the retracting excursion of the piston.

Figure 3:
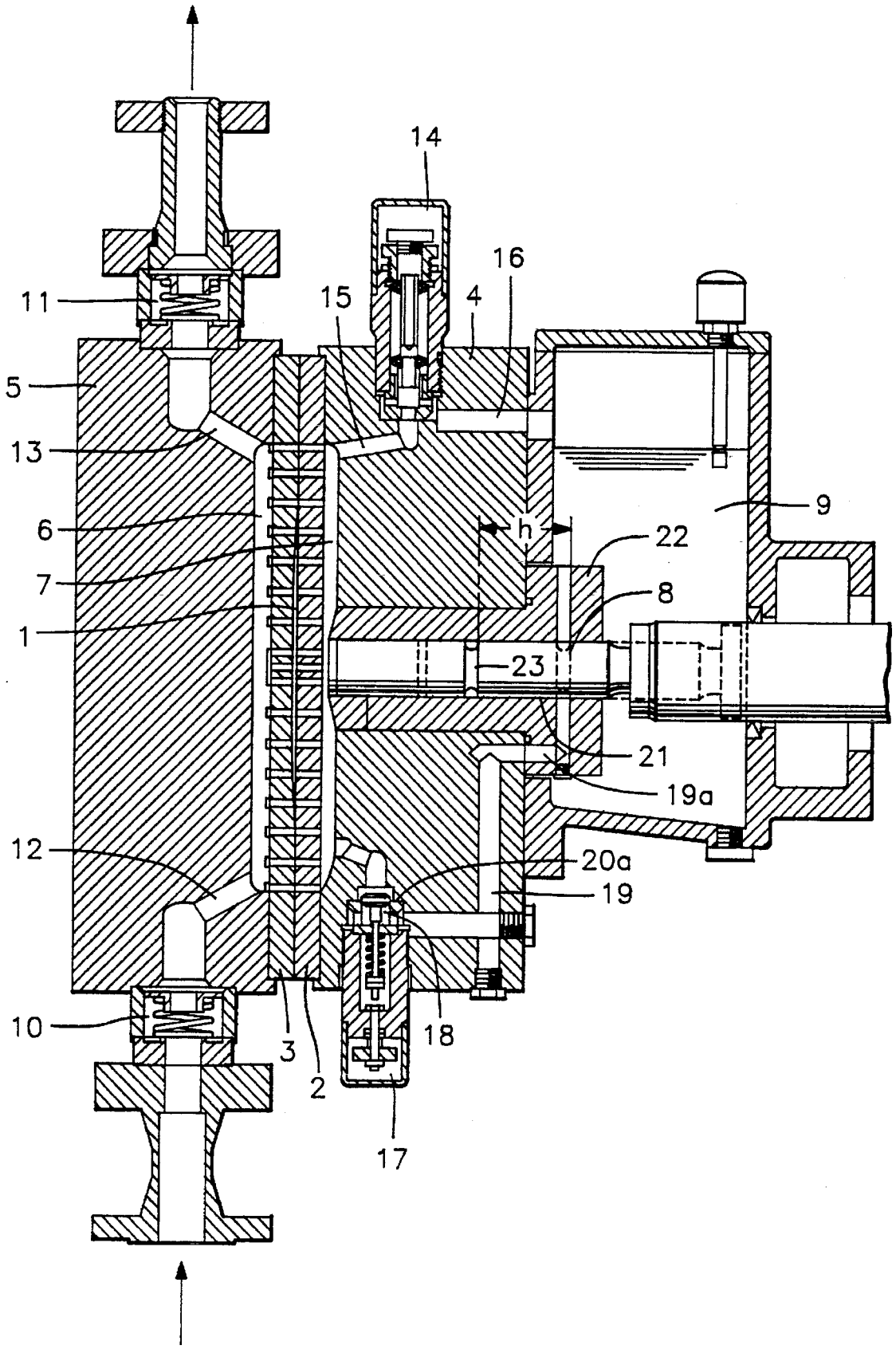
FIG. 3 shows a variant embodiment with low-pressure-side control of the relief prevention.

The variant embodiment illustrated in FIG. 3 has a low-pressure-side control of the means of blocking the snuffle action as contrasted with the high-pressure-side control of FIG. 1. The variant of FIG. 3 is particularly suitable for membrane pumps which have a constant stroke length and wherein, again, as in FIG. 1, so called ground seal (close mating) means are used to seal the piston 8 in the associated cylinder bore 21.

As seen from FIG. 3, the compression-space-side channel 20*a* leading from the leak replenishment device 17 is not configured to open out into the cylinder 21 of the displacing piston 8 but instead runs to the compression space 7, opening out into the end-face wall of same, as shown.

A reservoir-space-side channel 19 is also provided, which runs from the snuffle valve 18 to the reservoir space 9 but not directly; the end of channel 19 distant from the snuffle valve 18 opens out into an extension channel 19*a* which extends transversely to the axis of the displacing piston 8 and into a terminal piece 22 which has a guide bore for the piston 8, and the continuation of channel 19*a* thereafter opens out into the reservoir space 9.

At a certain location along the longitudinal dimension of the piston 8 a ring-shaped groove 23 is provided. This location is chosen such that when the piston 8 is at its forward dead center position (at the terminus of the compression stroke) as shown in FIG. 2, the groove is at a distance h from the extension channel 19*a* which distance is equal to the stroke of the piston. The piston position illustrated in FIG. 3 also represents the beginning of the suction stroke, corresponding to position 3*p* in the two diagrams of FIG. 2. In this position the piston blocks off the extension channel 19*a* and thereby blocks the snuffle link between the reservoir space 9 and the compression space 7. In the course of the suction stroke from left to right in FIG. 3, the piston 8 will pass through the position corresponding to position 4*p* of the diagrams of FIG. 2 (where pressure=ps; underpressure=po−ps). The underpressure peak will occur as described but is unable to lead to a premature response of the snuffle valve 18, because the ring-shaped groove 23 on the piston 8 is still at a distance from the extension channel 19*a*, wherewith the snuffle link to the reservoir space is still blocked.

When thereafter the piston 8 reaches the end of its suction stroke, corresponding to position 1*p* of the diagrams of FIG. 2, illustrated by the dashed lines of FIG. 3, the ring-shaped groove 23 of piston 8 is now at the level of the extension channel 19*a*, whereby the snuffle link between reservoir space 9 and compression space via the channels 19*a*, 19, 20*a* is made available. If at this point there develops (or exists) an excessive underpressure in the hydraulic system due to an insufficiency of hydraulic fluid, the snuffle valve 18 will respond and automatically supply the additional hydraulic fluid required, from the reservoir space 9. When thereafter the piston 8 begins its compression stroke and moves from position 1*p* to position 2*p* in the diagrams of FIG. 2, the ring-shaped groove 23 of the piston 8 is promptly moved out of correspondence with the extension channel 19*a*, whereby channel 19*a* is quickly blocked and the snuffle link is interrupted.

Figure 4:
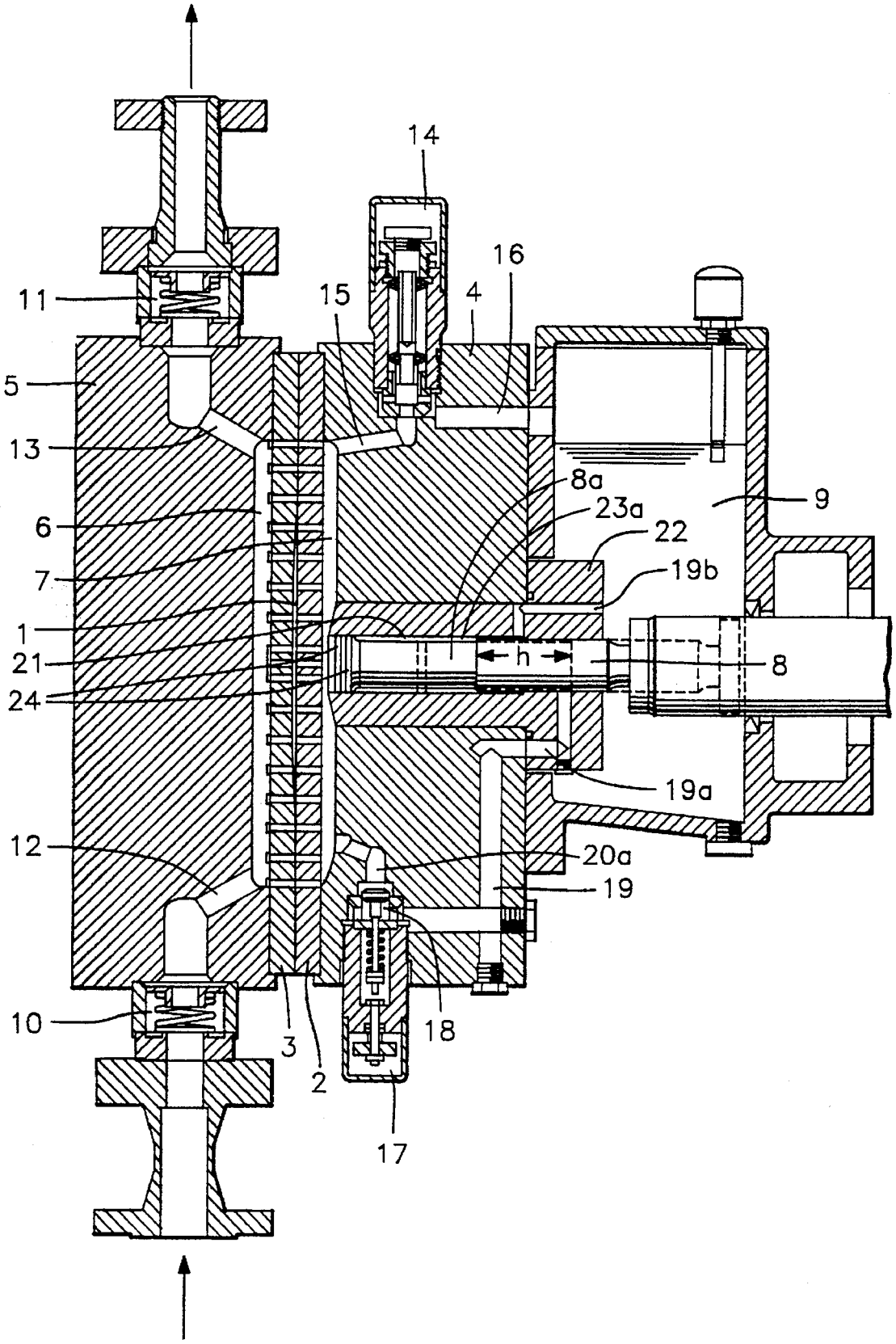
FIG. 4 is a variant of the embodiment of FIG. 3, again with low-pressure-side control.

In the refinement according to FIG. 4 the general arrangement is similar to that of FIG. 3, with the difference being that the seal of the piston 8 in its cylindrical bore 21 is not a close-mated "ground seal", but is provided by sealing rings of the piston ring type 24, mounted on piston 8 in a customary fashion.

Further, instead of a ring-shaped groove, the piston 8 has an entire segment 8*a* of reduced diameter, providing an annular void 23*a* between the reduced-diameter piston segment 8*a* and the associated cylindrical bore 21. The function of the void 23*a* of FIG. 4 is the same as that of the ring-shaped groove 23 of FIG. 3.

As seen, the extension channel 19*a* connected to the reservoir-space-side channel 19 of the snuffle device 17 is configured such that in its passage transversely to the axis of the piston 8 it does not traverse the entire terminal piece 22 but only opens out into the cylindrical bore 21 associated with the piston 8. A second channel 19*b* provided in piece 22 provides the link between the extension channel 19*a* and the reservoir space 9 when the piston 8 is in an enabling position. Channel 19*b* extends from the reservoir space 9 to the cylindrical bore 21 associated with the piston 8, opening out into the bore at a location which is offset along the axis of the bore 21 with respect to the location at which the extension channel 19*a* opens out into the bore 21.

As seen from FIG. 4, in the position of piston 8 illustrated, which corresponds to position 3*p* in the diagrams of FIG. 2, representing the beginning of the suction stroke, the snuffle link between the reservoir space 9 and the compression space 7 is blocked off. The link remains blocked as the piston 8 passes through the position corresponding to position 4*p* of the diagrams of FIG. 2 (pressure=ps; underpressure=po−ps), during the suction stroke of the piston, in that the channels 19*a* and 19*b* continue to be blocked off by the piston 8. Accordingly, the underpressure peak which occurs when the piston moves into this position cannot lead to a premature response of the snuffle valve 18. Only later, as the piston 8 approaches and reaches the position corresponding to position 1*p* in the diagrams of FIG. 2, in the course of executing the remaining part of the suction stroke, does the reduced-diameter segment 8*a* of the piston 8 enter the region of the openings of the channels 19*a* and 19*b*. When this occurs, the link is thereby established between channels 19*a* and 19*b* via the annular space 23*a*, thereby opening the snuffle link between the reservoir space 9 and the compression space 7, and enabling leak replenishment, if needed, to take place via snuffle valve 18.

Figure 5:
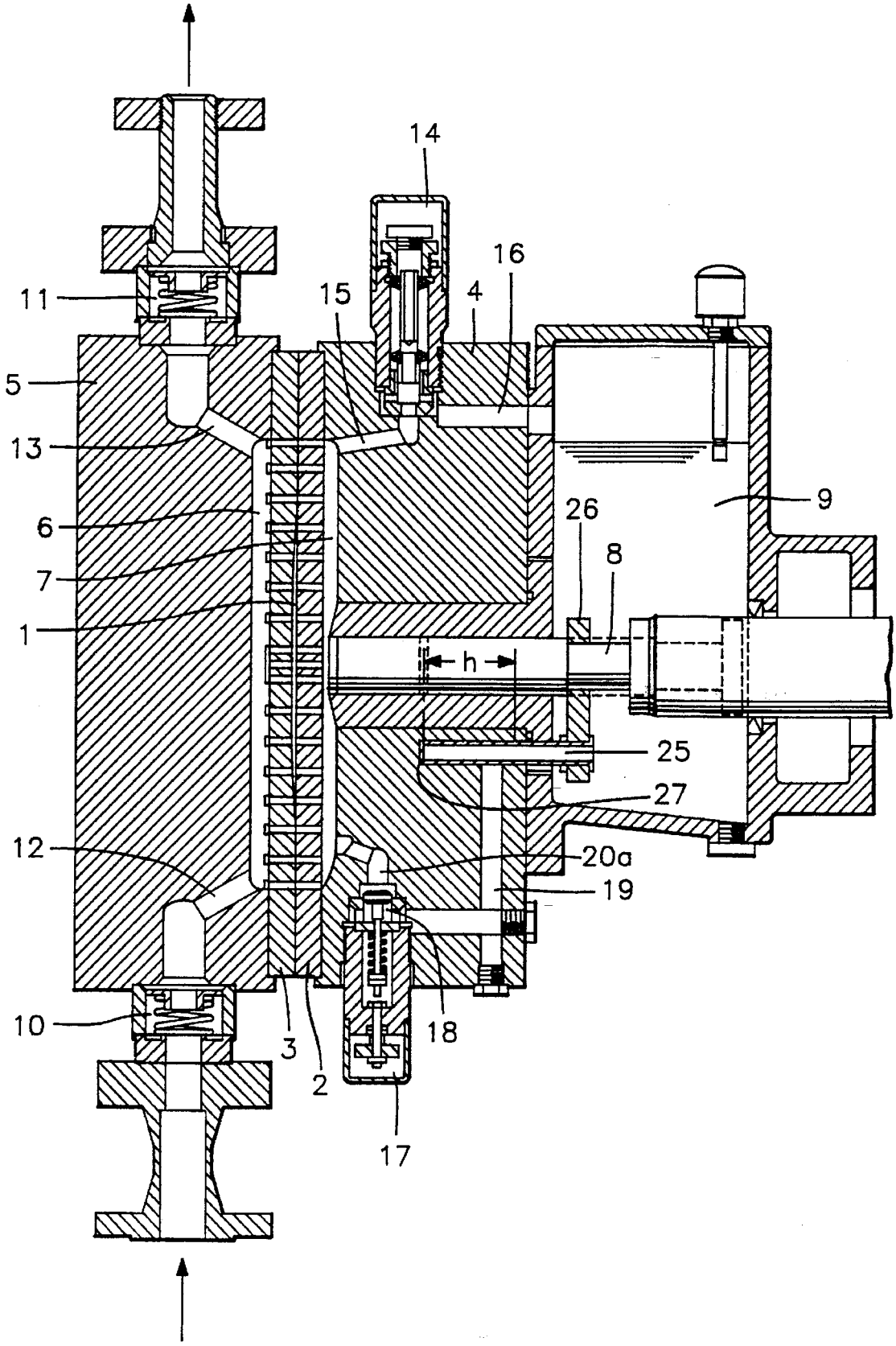
FIG. 5 is another variant embodiment, again with low-pressure-side control, having a second control piston (auxiliary servo slide valve) (also known as a sleeve valve).

In the refinement according to FIG. 5 the control of the blockage of the snuffle action is again on the low-pressure-side (as with FIGS. 3–4). To achieve the control, the piston 8 is provided on its reservoir-space-side with a parallel disposed slide (sleeve) valve having a control piston slide element 25 which is distinct from the main piston 8. Control element 25 is mounted on a flange 26 affixed to piston 8 and is disposed in the vicinity of the circumference of piston 8. A corresponding channel 27 for element 25 is provided in the housing 4. As shown, the channel 27 communicates with the reservoir-space-side channel 19 of the leak replenishment device 17 and opens out into the reservoir space 9.

The control element 25 is hollow or is configured as a sleeve, with both ends open. When the main piston 8 is in the position illustrated, at the end of the compression stroke and the beginning of the suction stroke, corresponding to position 3*p* in the diagrams according to FIG. 2, the snuffle link between the reservoir space 9 and the compression space 7 is blocked, since the control element 25 is essentially completely inserted in the housing channel 27, thereby blocking off the reservoir-side channel 19. When the main piston 8 nears or reaches the end position of the suction stroke, corresponding to position 1*p* of the diagrams of FIG. 2, the control element 25, which moves in tandem with piston 8, is withdrawn past the junction orifice of channel 19 with housing channel 27, whereby the link between the reservoir-side channel 19 and the housing channel 27 is unblocked. This establishes the snuffle link between the reservoir space 9 and the compression space 7, via the hollow control element 25, the housing channel 27, the reservoir-space-side channel 19, and the compression-space-side channel 20*a*, wherewith when the underpressure in the compression space 7 reaches a certain value the snuffle valve 18 will respond, resulting in automatic leak replenishment from the reservoir space 9.

When the main piston 8 begins to execute the compression stroke again, moving from the withdrawn position to the compression position, corresponding to movement from position 1*p* to position 2*p* in the diagrams of FIG. 2, the control element 25 moving in tandem with piston 8 moves back into deeper penetration of the housing channel, again blocking off the reservoir-space-side channel 19.

I claim:

1. A hydraulically driven membrane pump comprising:

a membrane held between a pump housing and a pump cover, said membrane separating a pumping space from a hydraulic compression space, said pumping space being in communication with a pumped fluid inlet and a pumped fluid outlet, each having a valve, respectively, a hydraulic membrane drive in the form of a reciprocating displacement piston slidably mounted in a cylindrical bore in said pump housing, said piston being located between said compression space and a reservoir space for hydraulic fluid, a leak replenishment device including a snuffle link in the form of a connecting channel between said compression space and said reservoir space, said snuffle link being normally closed off by an underpressure controlled spring-loaded snuffle valve, said snuffle link between said compression space and said reservoir space being controlled via the position of said piston, said piston being a slide element of a slide valve blocking said snuffle link between said compression space and said reservoir space, at least at a beginning of a suction stroke of said piston, and only opening said snuffle link when said piston has been retracted beyond said beginning of said suction stroke.

2. A membrane pump according to claim 1, wherein said piston opens up said snuffle link between said compression space and said reservoir space after said piston has executed approximately one half of its suction stroke.

3. A membrane pump according to claim 1, wherein said piston keeps a reservoir-space-side channel of said snuffle link blocked off at least at the beginning of the suction stroke of said piston.

4. A membrane pump according to claim 3, wherein said reservoir-space-side channel of said snuffle link opens out into said cylindrical bore associated with said piston and is brought into communication with a piston channel leading; to said reservoir space, said communication being available when said piston has executed a part of its suction stroke.

5. A membrane pump according to claim 3, wherein said piston is connected on a reservoir-space-side end to a parallel disposed auxiliary slide valve serving a control function, said auxiliary slide valve has a slide element slidable in a part of said reservoir-space-side of said snuffle link and blocks off or opens up the connection of said channel to said reservoir space depending on a position of said piston along the stroke of said piston.

6. A membrane pump according to claim 5, wherein said slide element in said auxiliary slide valve is hollow.

7. A membrane pump according to claim 1, wherein said piston keeps a compression-space-side channel of said snuffle link blocked off at least at the beginning of the suction stroke of said piston.

8. A membrane pump according to claim 7, wherein said compression-space-side channel of said snuffle link opens out into said cylindrical bore associated with said piston.

* * * * *